US005099658A

United States Patent [19]

Utter et al.

[11] Patent Number: 5,099,658

[45] Date of Patent: Mar. 31, 1992

[54] CO-ROTATIONAL SCROLL APPARATUS WITH OPTIMIZED COUPLING

[75] Inventors: Robert E. Utter, Onalaska; Daniel R. Crum, La Crosse, both of Wis.

[73] Assignee: American Standard Inc., New York, N.Y.

[21] Appl. No.: 611,226

[22] Filed: Nov. 9, 1990

[51] Int. Cl.[5] ..... F01C 1/04; F01C 17/06

[52] U.S. Cl. ..... 62/498; 418/1; 418/55.3; 418/188

[58] Field of Search ..... 418/1, 55.3, 188; 62/498

[56] References Cited

U.S. PATENT DOCUMENTS 4,178,143 12/1979 Thelen et al. ..... 418/55.3
4,753,582 6/1988 Morishita et al. ..... 418/188
4,927,339 5/1990 Riffe et al. ..... 418/55.3

*Primary Examiner*—John J. Vrablik

*Attorney, Agent, or Firm*—William J. Beres; William O'Driscoll; David L. Polsley

[57] ABSTRACT

In a co-rotational scroll apparatus having two interleaving scroll wraps secured to end plates rotating about parallel, non-concentric axes to produce a relative orbital motion, a coupling for causing concurrent rotation and for enhancing the nutational stability of the scroll element. In the preferred embodiment, the nutation reducing means is comprised of an Oldham-type coupling engaging extension members on one of the scroll end plates and drive keys on the other respective end plate. The angular disposition thereof is optimized to cause the Oldham coupling to generate during rotation a moderating moment load in opposition to the tipping moment load of at least one of the scroll elements and thereby enhance the nutational stability of the scroll elements. The moderating moment load of the coupling imposed on the scroll elements may be altered by varying the angular and radial disposition of the center of gravity of the coupling.

17 Claims, 4 Drawing Sheets

CO-ROTATIONAL SCROLL APPARATUS WITH OPTIMIZED COUPLING

TECHNICAL FIELD

This invention generally pertains to scroll apparatus and specifically to co-rotating scroll-type fluid apparatus having a coupling drivingly connecting between the scrolls for causing concurrent rotation of the scroll members, the coupling being optimized to enhance the nutational stability of the scroll appartaus during rotation of the scroll elements.

BACKGROUND ART

Scroll apparatus for fluid compression or expansion are typically comprised of two upstanding interfitting involute spraidal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radially exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to relative non-rotational motion. The general principles of scroll wrap generation and operation are discussed in numerous patents, such as U.S. Pat. No. 801,182.

Numerous attempts have been made to develop corotational scroll apparatus. Such apparatus provides for concurrent rotary motion of both scroll wraps on parallel, offset axes to generate the requisite orbital motion between the respective scroll wrap elements. However, most commercially successful scroll apparatus to date have been of the fixed scroll-orbiting scroll type due to various difficulties in achieving success with co-rotating scroll apparatus.

Typically, a number of rotary bearings are required in a co-rotational scroll apparatus, which decreases the reliability and efficiency of the machine. Furthermore, the typical co-rotating scroll apparatus have required a thrust bearing acting upon ecah of the scroll end plates to prevent axial scroll separation, thus substantially increasing the power requirements of the machine as well as substantially reducing the reliability of the machine.

An additional problem which must be dealt with in scroll apparatus, whether used for compression or decompression of fluid, are the forces which result from the fluid trapped in the chambers formed in the scroll wraps. These forces include an axial separation force component resulting from the fluid pressure upon the scroll element end plates and a radial separation force resulting from the fluid pressure upon the scroll wraps themselves. Futhermore, the separation forces due to the fluids compressed within the scroll elements vary cyclicly as the scroll elements rotate. This cyclic variation is a function of two factors. The first is the instantaneous location of each of the compression chambers formed by the scroll wraps during each revolution. The chamber location is a function of the angular and radial dispositon of the center of the chamber with respect to the center of the scroll apparatus at a given crankangle. The second is the actual pressure of the compressed fluid, which varys according to the instantaneous location of the compression chamber in which the fluid is contained, decreasing from the radially outer ends of. the respective scroll wraps to the radially outer ends thereof. Both these factors combine to produce a moment, the product of the instantaneous center of the compression chamber location and the instantaneous fluid pressure forces at that location. The resulting tipping moment upon the scroll member is the net effect of the moments developed by each compression chamber. The tipping moment acts perpendicularly to the axis of rotation of the scroll member, and therefore seeks to cause the tipping of the scroll element. Since the magnitude of the tipping moment is more pronounced at various crankangle positions during the rotation of the scroll element, actual tipping may occur at some crankangle positions, while it may be prevented at other positions by other forces sufficiently exerted on the scroll members. Actual tipping is observable as a rocking or nutation of the scroll member during rotation.

Typically, this is dealt with by the provision of an axial force acting to compress the end plates of the scroll elements together, in opposition to the separatin fluid forces and by the provision of relatively larger bearings. These compressive axial forces are typically induced either mechanically by such means as thrust bearings or springs, or by fluid pressure imposed upon the opposite side of the scroll end plate.

Prior scroll apparatus attempt to counter the nutation effect by simply increasing the axial force loading upon the scroll end plate until the tipping moments are overcome, by providing a larger number of bearings for supporting the scroll member shafts to prevent the shaft misalignment which occurs during tipping, and by decreasing the manufacturing tolerances of the components. All of these solutions increase the size and number of components of the scroll apparatus as well as the initial and operating costs, and also decrease the expected operating life of the scroll apparatus.

These solutions also undesirably affect the performance of the scroll apparatus as well. Because the axial force provided remains constant at any given operating condition, the axial force loading remains relatively high even when the separation effects of the tipping moment are low, which is typically the case during most of the scroll rotary cycle. Hence, there are unnecessarily high forces acting upon the scroll wrap tips at many crankangle positions in the scroll cycle, with resulting unnecessary friction and wear as well as excessive power consumption and loss of overall efficiency.

Futhermore, even when the axial force loading is relatively high, tipping of the scroll member can occur at some crankangle positions during rotation of the scroll apparatus. When nutation of the scroll element does occur, the scroll wrap tips can momentarily separate from the opposing scroll end plate. This permits fluid to pass from higher pressure compression chambers to lower pressure chambers, requiring recompression of the fluid and again reducing the overall efficiency of the scroll apparatus.

In co-rotational scroll apparatus having a coupling engaging the scroll members for causing the concurrent scroll rotation, an additional moment is caused by the action of the couping in the apparatus. This is due to the rotation of the mass of the coupings, which rotates about a point defined between the axes of the scroll members. Since the center of rotation of the coupling is not concurrent with the center of the scroll members, nutation of the scroll members may be induced by the coupling due to the moment generated by the offset of the coupling mass with respect to the axis of the scroll members. The nutation causing effect of the coupling may be even more pronounced in cases where the center of gravity of the coupling mass is not identical with the physical center of the coupling, so that the offset of the coupling mass is increased.

The typical solutions applied to the tipping effects of the coupling are identical to those applied to the scroll members themselves and the identical consequences may be observed.

Therefore it is an object of the present invention to provide a scroll apparatus as will provide the highest possible efficiency while utilizing the least amount of power and therefore having the lowest power and least constly drive means.

It is a further object of the present invention to provide such a scroll apparatus as will reduce and moderate the scroll member net tipping moment in a rotating scroll apparatus by appropriate disposition of a drive coupling.

It is still a further object of the present invention to provide such a co-rotating scroll apparatus which is of simple construction and high operating reliability.

It is yet a further object of the present invention to provide a co-rotating scroll apparatus which is relatively compliant and not susceptible to damage in operation.

Finally, it is an object of the present invention to provide such a scroll apparatus as is suitable for and is relatively inexpensive in mass production.

SUMMARY OF THE INVENTION

The subject invention is a method and means for enhancing the rotational stability of at least one of the scroll members or element in a co-rotational scroll apparatus having two concurrently rotating scroll members, each scroll member including an end plate and a scroll wrap thereon having at least an involute portion for interleaving engagement with the scroll wrap of the other scroll member and rotating on an axis parallel to the axis of the other scroll member.

Specifically, the subject invention includes a coupling engaging one or both of the scroll members in a corotational scroll apparatus and may be employed as an Oldham-type drive coupling for ensuring concurrent rotation of the scroll members. While the shape of the coupling can readily be varied, the coupling has a mass which locates or defines a coupling center of gravity. This center of gravity is disposed so that the mass of the coupling produces a moment opposing the tipping amount generated within the scroll members in the range of crankangle positions where tipping is most likely to occur. The coupling moment so generated may be referred to as a moderating moment. In alternative embodiments, the coupling may also include an additional mass disposed on the coupling to further alter the disposition of the coupling center of gravity. By generating a moment in opposition to the tipping moment of the scroll members, the nutational stability of the scroll members during rotation is enhanced. According to the method of the subject invention, the magnitude of the instantaneous moment resulting from fluid forces acting upon the scroll element, or tipping moment, is determined for each radial point or position throughout the rotation of the scroll element. From this, the maximum tipping moment acting upon the scroll member and the range of crankangle positions through which the maximum tipping moment acts can be found. The instantaneous moment generated by the coupling, also referred to as the moderating moment, can also be determined as a function of the mass of the coupling and the relative position of the center of gravity of the coupling. The angular disposition of the coupling necessary to sufficiently moderate or reduce the maximum determined tipping moment of the scroll members if then also determined. The coupling is then placed at the predetermined angular disposition to reduce the nutation of the scroll members.

An exemplary co-rotational scroll apparatus which may suitably employ the subject invention is also presented.

DESCRIPTION OF THE PREFERRED EMBODIMENT

Figure 1:
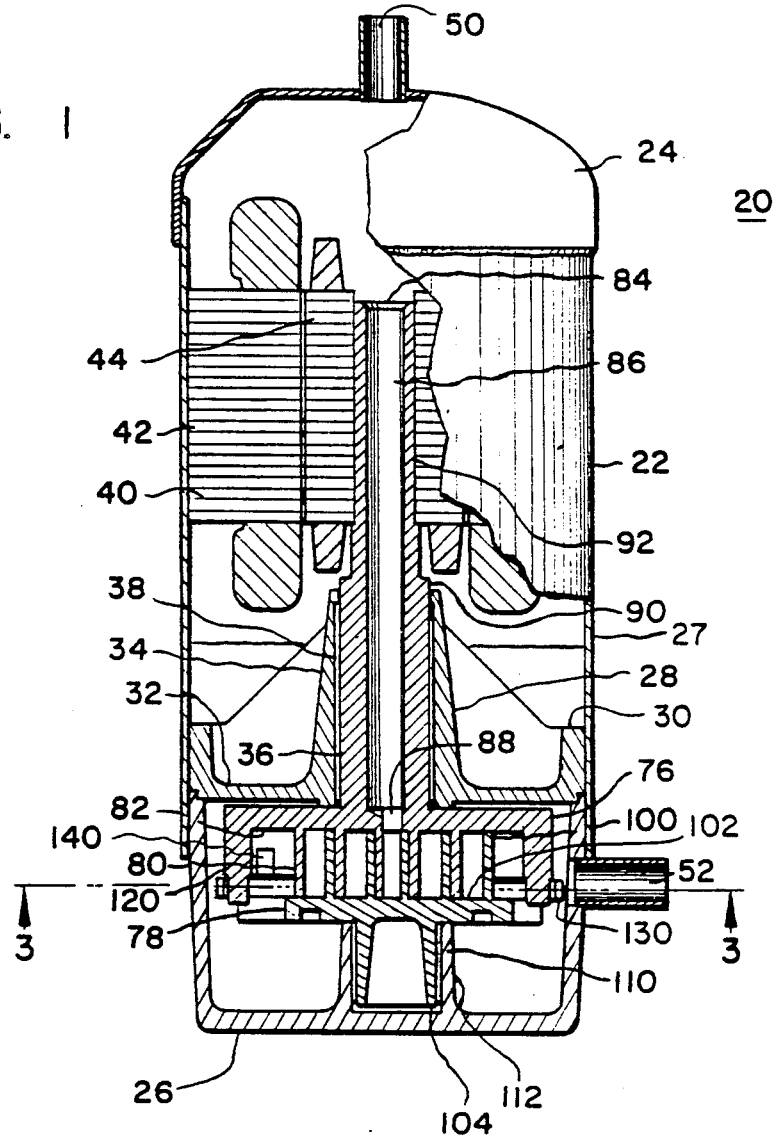
FIG. 1 discloses a cross-sectional view of a co-rotational scroll apparatus embodying the subject invention.

A scroll type fluid apparatus generally shown in FIG. 1 as a scroll compressor assembly is referred to by reference numeral 20. As the preferred embodiment of the subject invention is a hermetic scroll compressor assembly, the scroll apparatus 20 is interchangeably referred to as a scroll compressor 20 or as a compressor assembly 20. It will be readily apparent that the features of the subject invention will lend themselves equally readily to use in a scroll appartaus acting as a fluid expander, a fluid pump, or to scroll apparatus which are not of the hermetic type.

In the preferred embodiment, the compressor assembly 20 includes a hermetic shell 22 having an upper portion 24, a lower portion 26, a central exterior shell 27 extending between the upper portion 24 and lower portion 26, and an intermediate, central frame portion 28 affixed within the central exterior shell 27. The exterior shell 27 is a generally cylindrical body, while the central frame portion 28 is defined by a generally cylindrical or annular exterior portion 30 and a central portion 32 disposed across one end thereof. The annular exterior portion 30 of the central frame portion 28 is sized to sealingly fit within the exterior shell 27 so that it may be mated thereto by a press fit, by welding, or by other suitable means.

Integral with the central frame portion 28 is a generally cylindrical upper bearing housing 34, which is substantially coaxial with the axis of the annula exterior portion 30. A drive shaft aperture 36 extends axially through the center of the upper bearing housing 34, and and upper main bearing 38 is disposed within the drive shaft aperture 36. Preferably, the upper main bearing 38 is made, for example, of sintered bronze or similar material, but may also alternatively be a roller or ball-type bearing, for accepting a rotating load therein.

A motor 40 is disposed within the upper portion 24 and central shell portion 27 of the hermetic shell 22. The motor 40 is preferably a single-phase or three-phase electric motor comprised of a stator 42 which is circumferentially disposed about a rotor 44, with an annular space formed therebetween for permitting free rotation of the rotor 44 within the stator 42 as well as the flow of lubricant or refrigerant fluid.

It will be readily apparent to those skill in the art that alternative types of motors 40 and means of mounting motor 40 would be equally suitable for application in the subject invention. For example, the stator 42 could be secured within the central shell portion 27 by a press fit therebetween. Alternatively, a plurality of long bolts or cap screws (not shown) may be provided through appropriate apertures in the stator plates into threaded apertures in the central frame portion 28 for securing the motor 40 within the hermetic shell 22.

The scroll arrangement includes a first or drive scroll member 76 and a second or idler scroll member 78, each having an upstanding involute scroll wrap for interfitting engagement with the other respective scroll wraps. The first scroll member 76 includes an upstanding first involute scroll wrap 80 which is integral with a generally planar drive scroll end plate 82. The drive scroll end plate 82 includes a central drive shaft 84 extending oppositely the upstanding involute scroll wrap 80. A discharge gallery 86 is defined by a bore extending centrally through the axis of the drive shaft 84. The discharge gallery 86 is in flow communication with a discharge aperture 88 defined by a generally central bore through the drive scroll end plate 82. The drive shaft 84 further includes a first, relatively large diameter portion 90 extending axially through the upper main bearing 38 for a free rotational fit therein, and a second relatively smaller diameter portion 92 which extends axially through the rotor 44 and is affixed thereto. The rotor 44 may be affixed to the rotor portion 92 of the drive shaft 84 by such means as a press fit therebetween or a power transmitting key in juxtaposed keyways.

Figure 3:
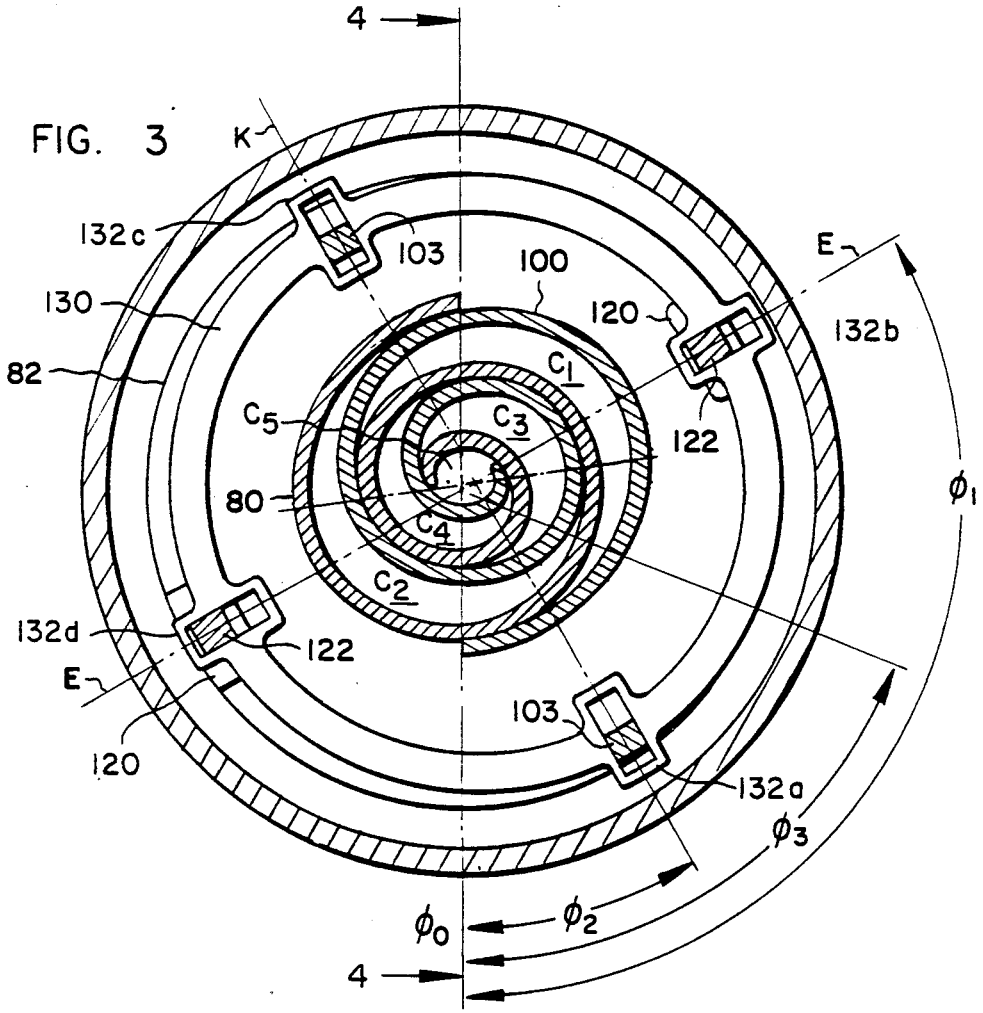
FIG. 3 shows a cross-sectional view of the scroll apparatus of FIG. 1 taken along section lines 3—3.

The second or idler scroll member 78 includes a second, idler scroll wrap 100 which is disposed in interfitting contact with the driven scroll wrap 80. The idler scroll wrap 100 is an upstanding involute extending from an idler end plate 102. Two rectilinear idler key stubs 103 extend upwardly on the idler end plate 102, as shown in FIG. 3. The idler key stubs 103 are disposed at radially opposed positions outside the idler scroll wrap 100. An idler stub shaft 104 extends from the idler end plate 102 oppositely the idler scroll wrap 100.

The designation of the drive scroll member 76 as the first scroll member and the idler scroll member 78 as the second scroll member must be understood as arbitrary, made for the purposes of ease of description and therefore not as a limitation. It would be equally accurate to designate the idler scroll member 78 as the first scroll member and the drive scroll member 76 as the second scroll member.

An annular bearing 110, which may be a sleeve bearing made of sintered bronze material, or may be of the roller or ball-type, is disposed within an annular wall defining an idler bearing housing 112 which is integral with the lower hermetic shell portion 26 as a support means for rotationally supporting the second or idler scroll member 78.

In the preferred embodiment, the drive scroll end plate 82 includes two radially opposed extension members 120 extending parallel the scroll wrap 80. The extension members 120 extend from positions near the outer periphery of the drive scroll end plate 82 and include end portions 122. The extension members 120 are also disposed at positions which are generally 90 degrees removed radially from the positions of the idler key stubs 103 when the scrolls 80 and 100 are in interleaving engagement.

Preferably, the extension members are disposed on a line EE which includes the center line, or the axis of rotation, of the scroll member 76, and hence are disposed at or substantially at 180 degrees of angular removal from each other. Likewise, the idler keys 103 are disposed on a line KK which includes the center line, or the axis of rotation, of the scroll member 78, and hence are also disposed at or substantially at 180 degrees of radial removal from each other.

A coupling in the form of a ring 130 rests on the idler scroll member end plate 102 in sliding engagement. The ring 130 is annular in form, extending noncontactingly about the radial exterior of the scroll wraps 80 and 100 and further having four rectilinear drive key slots **132*a*, 132*b*, 132*c*, and 132*d* defined through the coupling ring 130 at radially equidistant intervals of approximately 90 degrees about the annular body of the ring 130 to comprise two pairs of oppositely disposed slots 132, with slots 132*a* and 132*c* being one pair and slots 132*b* and 132*d* being the second pair. As shown particularly in FIG. 3, the ring 130 includes four generally rectilinear broadened portions through which the slots 132 are defined so that the slots 132** may be of suitable size to accomodate drive keys in sliding engagement.

The actual form of the ring 130 will depend somewhat upon the desired moderating moment sought from the coupling ring 130, as the ring is preferably made of steel, aluminum or a similar material capable of suitably transmitting rotational torque between the scroll members 76 and 78. It will be appreciated that the ring 130 may be formed to contain more or less mass in different portions of the annulus of the ring 130, and that one or more additional mass $m_a$ 140 may be applied by mechanical or other means to the ring 130 for obtaining a suitably moderating moment as set forth below. For example, it is possible to form the ring 130 with a constant radial thickness so that the center of mass $m_c$ of the coupling ring 130, the center of gravity cg, is centrally disposed in the coupling 130, or to provide a ring 130 having a varying radial thickness or varying height (measured in the axial direction) so that the mass is unequally distributed about the coupling 130, with the result that the center of mass $m_c$ of the coupling ring 130, the center of gravity cg, is eccentrically disposed.

Those skilled in the art will also recognize that there are many alternative embodiments of the coupling means formed by the extension members 120, the idler keys 103 and the ring 130. For example, the coupling means may include any combination of key and slot arrangements, such as providing ring 130 with the extension members 120 and keys 103 affixed thereon and engaging slots formed in the respective scroll end plates. It will also be apparent that there are functionally equivalent coupling means ensuring concurrent rotation of the scroll members which may be employed which include a displaceable center of gravity for producing a moderating moment in the scroll apparatus 20.

Figure 2:
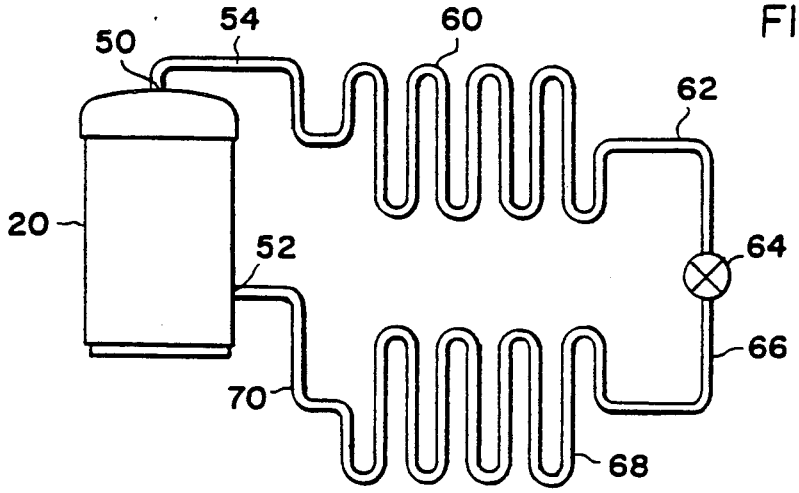
FIG. 2 discloses in schematic representation a refrigeration system in which the subject invention could be suitably employed.

In FIG. 2, the scroll compressor assembly 20 is shown connected at the discharge aperture 50 and the suction aperture 52 to a fluid system such as generally is used in refrigeration or air conditioning systems. Those skilled in the art will appreciate that this is but one fluid system in which the scroll compressor assembly 20 could suitably be utilized, and that application of the scroll compressor assembly 20 in refrigeration and air conditioning systems is to be taken as exemplary rather than as limiting.

The refrigeration system, shown generally in schematic representation in FIG. 2 in connection with the scroll compressor assembly 20, includes a discharge line 54 connected between the shell discharge aperture 50 and a condenser 60 for expelling heat from the refrigeration system and in the process typically condensing the refrigerant from vapor form to liquid form. A line 62 connects the condenser 60 to an expansion device 64. The expansion device 64 may be a thermally actuated or electrically actuated valve operated by a suitable controller (not shown), a capillary tube assembly, or other suitable means of expanding the refrigerant in the system. Another line 66 connects the expansion device 64 to an evaporator 68 for transferring expanded refrigerant from the expansion device 64 to the evaporator 68 for the acceptance of heat and typically the evaporation of the liquid refrigerant to a vapor form. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using suitably a scroll compressor apparatus 20 are well understood in the art, and that further detailed explanations of the devices and mechanisms suitable for constructing such a refrigeration system need not be discussed in detail herein. It is believed that it will also be apparent to those skilled in the art that such refrigeration or air conditioning systems may include multiple units of the compressor assembly 20 in parallel or series type connection, as well as multiple condensers 60, evaporators 68, or other components and enhancements such as subcoolers and cooling fans and so forth as are believed known in the art.

Figure 3A:
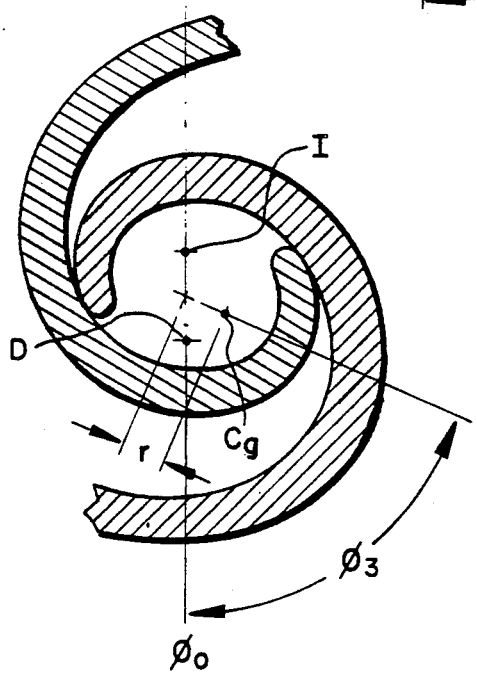
FIG. 3A shows a partial enlargement of the view of FIG. 3.

FIGS. 3 and 3A present cross-sectional views of FIG. 1 which more clearly disclose the subject invention. A line $phi_0$ is defined through the axis D of the drive scroll member 76 and axis I of the idler scroll member 78. Since these axes are fixed, the line $phi_0$ is also fixed with reference to the scroll apparatus 20 and may in turn be used as a line from which the angular disposition of the scroll apparatus components may be referenced. The line $phi_0$ also represents the point of zero crankangle and the point at which the outer ends of the respective scroll wraps 80 and 100 first make contact with the other respective scroll wrap to close the first or outer chamber.

The reference line $phi_0$ intersects a centerline C which is parallel to with and centrally disposed between the axis D of the first scroll 76 and axis I of the second scroll 78. This can be seen more clearly in FIG. 4, where 0 defines the offset distance between the axis D and the axis I, and line C is disposed a distance of $\frac{1}{2}$ 0 from these axes.

In FIG. 3, the center of gravity cg of coupling ring 130 is angularly disposed at an angle $phi_3$ from the line $phi_0$ to produce a moderating moment. The coupling ring 130, when slidingly engaging the extension members 120 and the idler keys 103, comprises means for enhancing the nutational stability of the scroll members. For convenience of description, the angle $phi_1$ of the coupling ring 130 is considered to define the line EE upon which the extension members 120 are disposed, while angle $phi_2$ refers to the angle at which the line KK is disposed from the line $phi_0$.

When the coupling ring 130 has a center of gravity Cg which is identical with the physical center of the coupling 130, the Cg is disposed at a distance r from the centerline C. The center of gravity Cg of the coupling ring 130 is disposed at angle $phi_3$ from a line $phi_0$. This is more clearly shown in FIG. 3A, which is an enlargement of the central portion of FIG. 3. Those skilled in the art will understand that the angle $phi_3$ and the distance r define the disposition of the center of gravity Cg when the scroll apparatus is at the position disclosed in FIG. 3, since the actual location of the center of gravity Cg changes as the scroll apparatus rotates. The center of gravity Cg therefore may follow a cardioidal path or other curvilinear path, depending primarily upon the actual embodiment of the coupling means.

Figure 4:
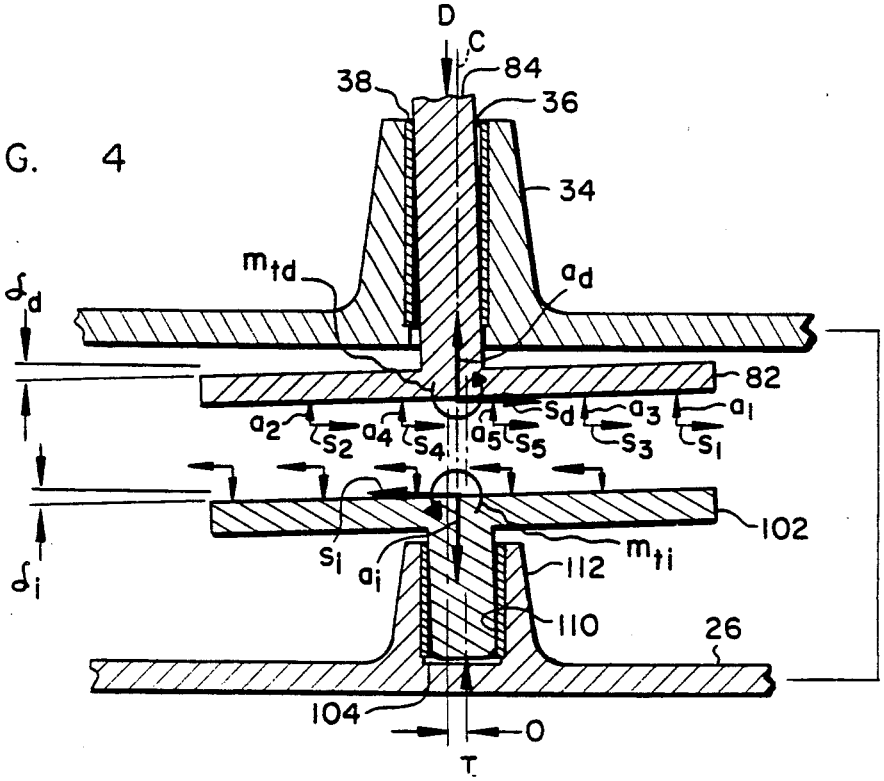
FIG. 4 shows the effect of the tipping moment upon a representative co-rotational scroll apparatus.

Turning now to FIG. 4, the effect of the fluid forces within the scroll wraps 80 and 100 upon the scroll apparatus 20 is more clearly depicted. This figure represents an exaggerated depiction of the effects of these forces. The force components depicted are not intended to indicate actual numerical quantity of a given force, but rather the direction in which the forces act. The scroll wraps themselves, the extension members 120, the coupling 130 and the keys 103 are deleted to permit a clearer view of the forces and the directions in which they act on each scroll.

FIG. 4 presents a cross-sectional view of the scroll apparatus 20 taken at an angular location at which there are five chambers $C_1$ through $C_5$, as shown in FIG. 3. Each of the chambers generates an axial separating force "a" and a radial separating force "s". For example, chamber $C_1$ would generate force vector $a_1$ as an axial separating force upon the end plate 82 tending to separate the drive scroll end plate 82 from the idler scroll end plate 102, and force vector $s_1$, a radial separation force, would act upon the scroll wrap 80 tending to cause a separation from the second scroll wrap 100. Both force vectors $a_1$ and $s_1$ would tend to cause a turning or tipping of the first scroll member 76 perpendicular to the axis of rotation of the scroll member. The total axial separation force "a" is equal to the vector sum $a_1$ plus $a_2$ plus $a_3$ plus $a_4$ plus $a_5$ and the net radial separation force s equals the vector sum $s_1$ plus $s_2$ plus $s_3$ plus $s_4$ plus $s_5$. The net effect of the separation forces is to produce a force "s" which is offset from the axis of rotation of the first scroll member 76 due to the fact that the fluid forces and chamber locations and sizes vary. As a result, an instantaneous tipping moment $m_t$ is produced. The moment $m_t$ acts upon the scroll member 76 to produce a tipping or nutation shown as angle $delta_d$. Because the chambers are disposed at the same radial and angular location and the fluid forces are the same, but the axes of the scroll members 76 and 78 are offset, the forces in each chamber act to produce a tipping moment $m_t$ for each scroll member 76 and 78, those being illustrated in FIG. 4 as $m_{ti}$ and $m_{td}$ respectively. Therefore, the forces in chambers C1 through C5 act to produce a tipping or nutation of the scroll member 78 shown as angle $delta_i$, which may differ from the angle $delta_d$ produced in the scroll member 76 due to differences in the number, types, and sizes of bearing supporting the respective scroll member shafts and other constraints on the respective scroll member end plates. The scroll wraps 80 and 100 will typically separate when $delta_i$ and $delta_d$ differ.

This calculation must be repeated for each angular position of the cycle of rotation for the respective scroll members 76 and 78. As shown in FIG. 4, an axial biasing force acting through axis D is provided by the axial biasing means. This force must be sufficient to exceed the axial separation force a, and in addition must supply a scroll tip contact force sufficient to prevent tipping of the scroll member end plate 82 at any given crankangle position. Where the force a exceeds the axial biasing force acting through axis D, tipping due to the tipping moment $m_t$ will occur. Tipping may even occur when the force a is less than the scroll axial biasing force where the force is insufficient to overcome both the separating force a and to provide an adequate counteracting moment.

Figure 5:
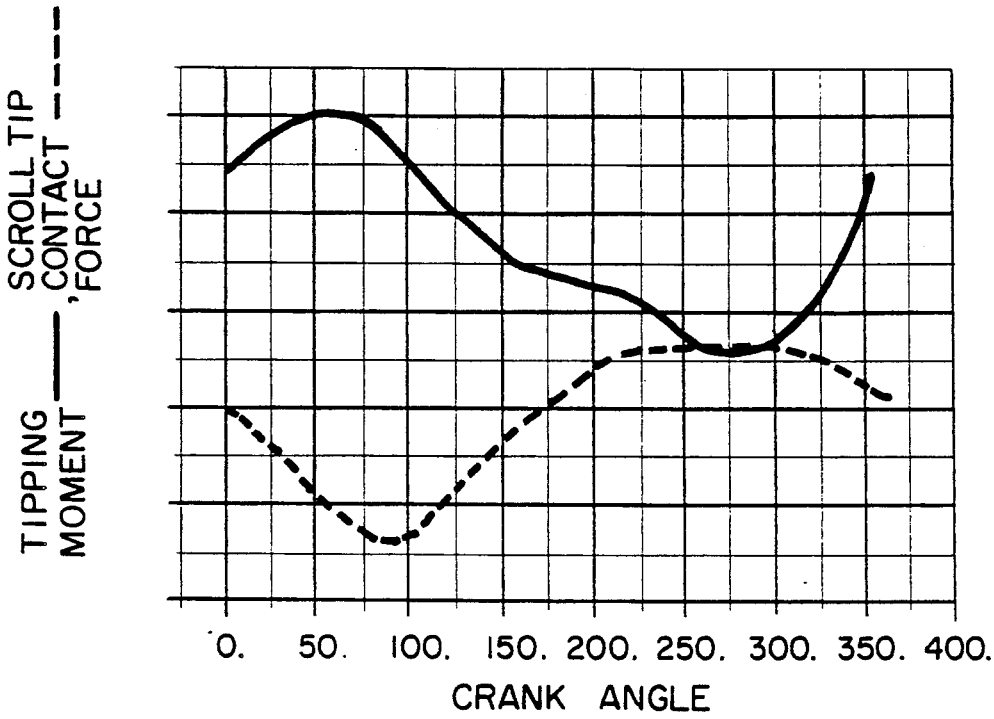
FIG. 5 is a diagram representative of the combined tipping moment and moderating moment, and of the axial scroll tip contact force acting upon one of the scroll members during the rotation of the scroll member in a co-rotational scroll apparatus.

FIG. 5 shows an analysis of the instantaneous moments acting upon one of the scroll members 76 or 78 during the rotation of the scroll member without the coupling 130. Crank angle position refers to the angular position of the respective scroll members as measured from the line $phi_0$, between 0° and 360° (one rotation) on the horizontal axis of the diagram, while the vertical axis discloses the moment experienced at each angular position. The exemplary curve representing the instanteous net moment at each position is roughly sinusoidal for a full rotation of the scroll member.

Figure 6:
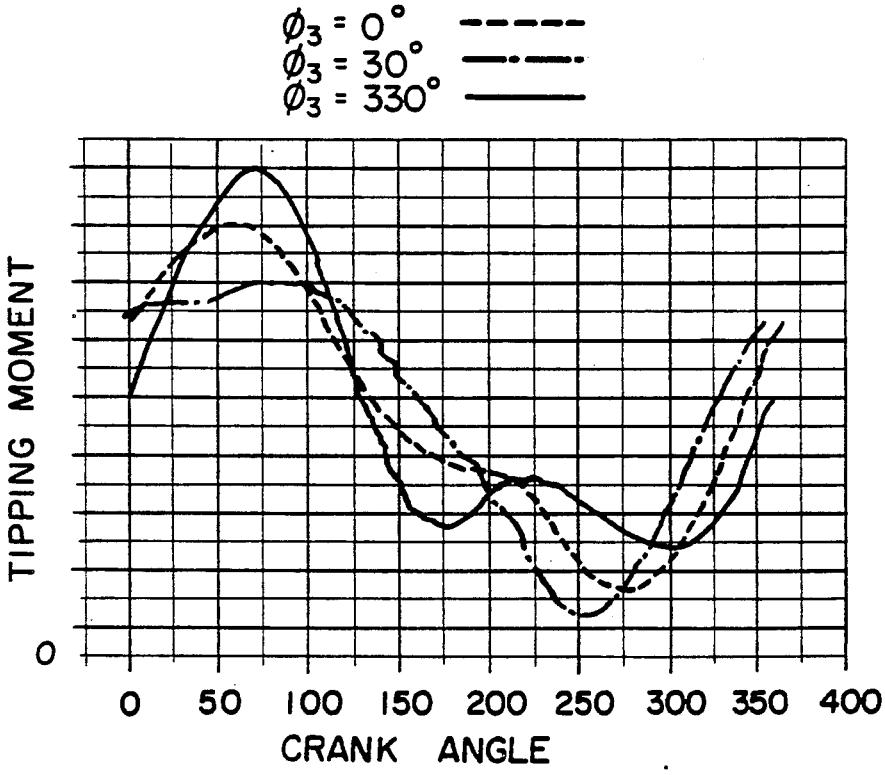
FIG. 6 is a diagram representative of the tipping moment as combined with various moderating moments, acting upon one of the scroll members during the rotation of the scroll apparatus.

FIG. 6 shows the instantaneous moments acting upon one of the scroll members 76 or 78 during the rotation of the scroll members with the Cg of the coupling 130 disposed at various angles $phi_3$, including $phi_3=0$ degrees, $phi_3=30$ degrees, and $phi_3=330$ degrees, where r is constant. It will be observed that the graph representing the instanteous moments for $phi_3=330$ degrees produces the highest maximum moment. The graph representing the instanteous moments for $phi_3=0$ degrees produces a lesser maximum moment. When the angle $phi_3=30$ degrees, the lowest maximum moment is produced in the exemplary apparatus. It will be appreciated that these graphs are illustrative and are by way of example only, rather than limiting, since the actual angle $phi_3$ selected for disposition of the coupling means will vary for each scroll apparatus 20 to which the subject invention is applied, and the actual nutation observed in any scroll apparatus 20 depends upon the actual tipping moment at any angular position versus the available counteracting moment for preventing nutation.

The method of reducing the net moment of the scroll member by providing a moderating moment with the coupling 130 includes the following steps: the instantaneous tipping moment acting upon a first scroll is determined for each angular position; the maximum tipping moment together with the angular or crankangle position or range of angular positions at which the maximum tipping moment acts is then determined; a moderating moment required to moderate the first scroll maximum tipping moment is determined, based on the mass of the coupling ring 130, and the radial and angular disposition $phi_3$ of the center of gravity Cg of the coupling ring 130 to induce the desired moderating moment; and engaging the first and second scroll members with the coupling Cg disposed at the angle $phi_3$ by disposing the extension members 120 on a line EE at the angle $phi_1$ and the idler key stubs 103 on a line KK at the angle $phi_2$. Preferably, the maximum tipping moment, together with the range of crankangle positions at which the maximum tipping moment acts, is also determined for the second scroll by application of the same methodology so that the desired moderating moment may be produced by orienting the coupling to the advantage of the second scroll member if it is more beneficial to do so.

Figure 7:
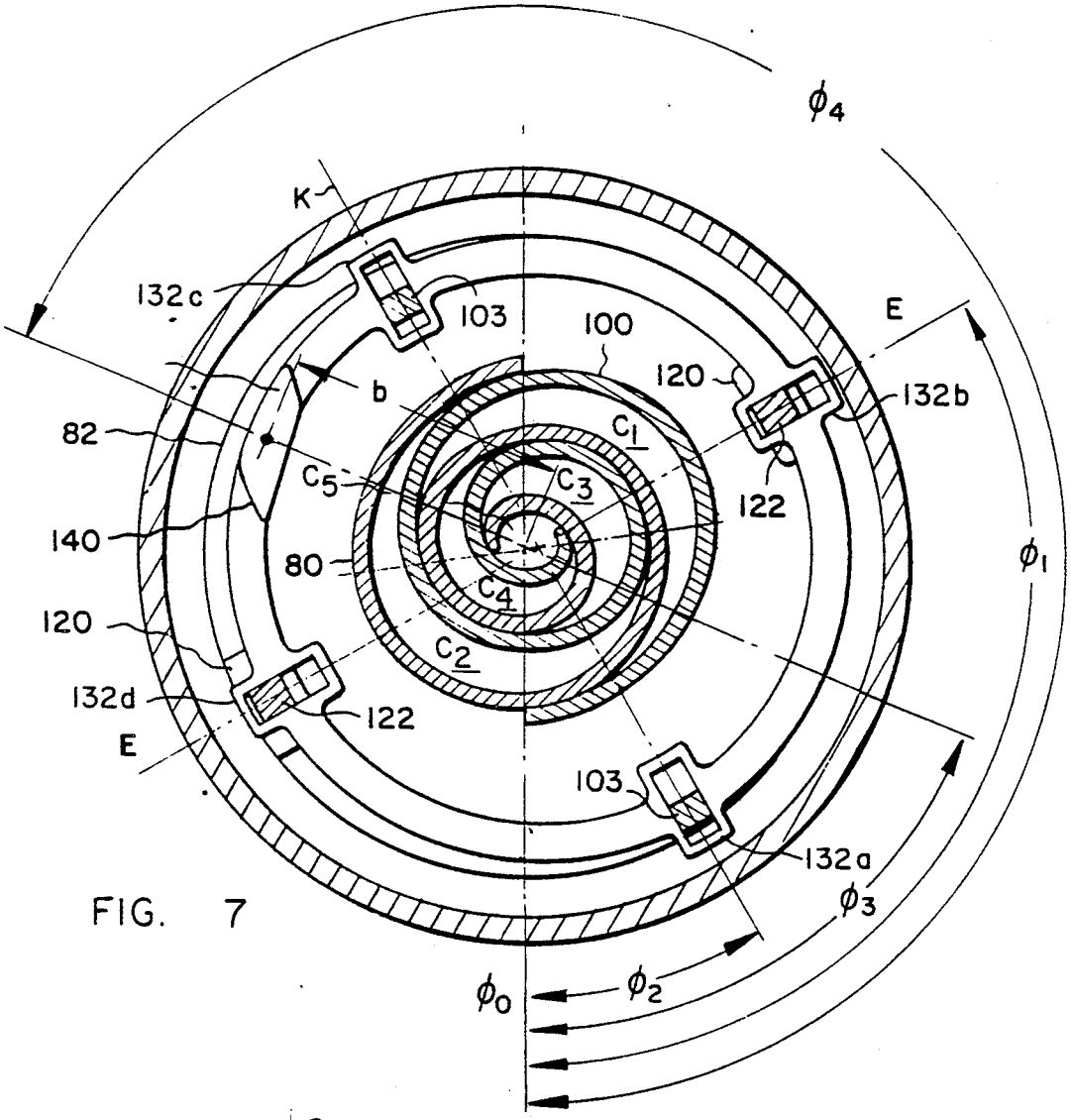
FIG. 7 discloses an alterative embodiment of the scroll apparatus of FIG. 3.

As noted above and shown in FIG. 7, one or more additional masses $m_a$ 140 may be asymmetrically applied to the coupling 130 which, as is illustrated in FIGS. 1, 3 and 7 is generally symmetrical, either mechanically such as by welding or adhesive, or integrally at the time of manufacture. The mass $m_a$ moves the center of gravity Cg off the axial centerline of the coupling 130 and alters the moderating moment generated by the coupling 130. However, the determination of the angular positioning and amount of the mass $m_a$ is accomplished by determining the tipping moment to be overcome and the crank angle position of that tipping moment, and providing the mass $m_a$ on the coupling ring 130 at an angular position $phi_4$ and distance b from the line C so as to produce the desired moderating moment.

Those skilled in the art will recognize that enhancing the nutational stability of the co-rotating scroll apparatus 20 by optimizing placement of the coupling 130 to provide a moderating moment represents a substantial improvement in the art. No additional components are required in the scroll apparatus 20, and the initial cost and operating expense is therefore minimized. Furthermore, the moderating moment provided by the coupling reduces the required axial biasing force, reducing in turn the frictional losses between the tip scroll wraps 80 and 100 and the end plates 82 and 102, respectively, which in turn reduces the power consumption of the scroll apparatus 20 for a given capacity, permitting the use of smaller and lighter motors 40. In all respects, therefore, the subject invention represents a substantial improvement which reduces the initial cost and improves the overall efficiency of the scroll apparatus 20. Furthermore, although the subject invention is exemplified in a scroll apparatus 20 useful in refrigeration system applications, it will be undoubtedly appreciated that the subject invention is useful in all applications of the co-rotational scroll apparatus 20, including pumps, expanders, fluid driven engines, and other applications, with like improvement in performance and reduction of expense.

Modifications to the preferred embodiments of the subject invention will be apparent to those skilled in the art within the scope of the claims that follow:

What is claimed is:

1. A co-rotational scroll apparatus comprised of:

a first rotatable scroll member having a first scroll end plate, a first scroll wrap including a first upstanding involute portion disposed on said first scroll end plate, and a drive shaft disposed on said first end plate, said first scroll member being subject to a tipping moment when said apparatus is in operation, said tipping moment varying in accordance with the rotational position of said first scroll member within said apparatus:

a second rotatable scroll member having a second scroll end plate, a second scroll wrap including a second upstanding involute portion disposed on said second scroll end plate, said second scroll member being subject to a tipping moment when said apparatus is in operation, said tipping moment varying in accordance with the rotational position of said second scroll member within said apparatus, said second scroll involute portion cooperating with said first scroll involute portion to define a line of zero crank angle at which said first and said second scroll wraps make initial contact to define a closed radially outermost compression chamber therebetween;

means for coupling said first scroll member and said second scroll member for joint rotation, said coupling means being selectively positioned within said apparatus to produce a predetermined moderating moment when said apparatus is in operation, said selective positioning of said coupling means and the resulting production of said predetermined moderating moment proactively enhancing the nutational stability of said scroll apparatus by reducing the maximum tipping moment to which at least one of said first and said second scroll members is subjected when said apparatus is in operation; and means for rotating said first scroll member.

2. The scroll apparatus as set forth in claim 1 wherein said coupling means is positioned so that its center of gravity is disposed at a predetermined angle from said line of zero crank angle whereby the moment produced by the movement and mass of said coupling, when said apparatus is in operation, acts in opposition to and reduces said maximum tipping moment.

3. The scroll apparatus as set forth in claim 2 wherein the center of gravity of said coupling means is radially disposed at a predetermined distance from a predetermined centerline of the scroll apparatus.

4. The scroll apparatus as set forth in claim 1 wherein said coupling is a generally symmetrical coupling having an asymmetrically positioned moment producing mass.

5. The scroll apparatus as set forth in claim 4 wherein said moment producing mass is disposed at a predetermined angle from said line of zero crank angle.

6. A co-rotational scroll apparatus comprised of:

a hermetic shell having a suction pressure portion for containing a suction pressure fluid;

a first rotatable scroll member disposed in said suction pressure portion, said first scroll member having a first scroll end plate, a first scroll wrap including a first upstanding involute portion disposed on said first scroll end plate, and a drive shaft defining an axis of rotation disposed on said first end plate, said first scroll member being subject to a varying tipping moment as it rotates in operation;

a second rotatable scroll member disposed in said suction pressure portion, said second scroll member having a second scroll end plate, a second scroll wrap including an upstanding involute portion disposed on said second scroll end plate, said second scroll wrap defining a line, in cooperation with said first scroll wrap, of zero crank angle, and an idler shaft disposed on said second end plate, said idler shaft defining an axis of rotation offset from the axis of rotation of said drive shaft, said second scroll member cooperating with said first scroll member to define a centerline, said centerline being parallel to both said axis of rotation of said drive shaft, and said axis of rotation of said idler shaft and equidistant therebetween, said second scroll member being subject to a varying tipping moment as it rotates in operation;

selectively positioned means for drivingly coupling said first scroll member and said second scroll member, said coupling means having a center of gravity disposed at a predetermined angle from said line of zero crank angle so that the movement, mass and selective positioning of said coupling, when said scroll apparatus is in operation, produces a moderating moment which proactively enhances the nutational stability of said scroll apparatus by acting in opposition to and reducing the tipping moment to which at least one of said first and said second scroll members is subjected;

means for rotatably supporting said idler shaft in said suction portion of said hermetic shell; and means for rotating said first scroll drive shaft.

7. The scroll apparatus as set forth in claim 6 wherein the center of gravity of said coupling means is radially disposed at a predetermined distance from said centerline.

8. The scroll apparatus as set forth in claim 7 wherein said coupling is a generally symmetrical coupling of the Oldham type, said coupling having an additional asymmetrically disposed moment producing mass.

9. The scroll apparatus as set forth in claim 8 wherein said additional asymmetrically disposed mass is disposed at a predetermined angle from said line of zero crank angle.

10. The scroll apparatus as set forth in claim 9 wherein said additional asymmetrically disposed mass is disposed at a predetermined distance from said centerline.

11. The scroll apparatus as set forth in claim 10 wherein said additional asymmetrically disposed moment producing mass is a discrete mass mechanically attached to said generally symmetrical coupling.

12. The scroll apparatus as set forth in claim 10 wherein said moment producing mass is integral to said coupling.

13. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and sending the refrigerant to the condenser, said compressor having i. a hermetic shell having a suction pressure portion for containing a suction pressure fluid;

ii. a first scroll member disposed in said suction pressure portion and subject to a varying tipping moment when said compressor is in operation, said first scroll member having a first scroll end plate, a first scroll wrap, said first scroll wrap being an upstanding involute portion disposed on said first scroll end plate, and a drive shaft having an axis of rotation, said drive shaft being disposed on said first end plate;

iii. a second scroll member disposed in said suction pressure portion and subject to a varying tipping moment when said compressor is in operation, said second scroll member having a second scroll end plate, a second scroll wrap, said second scroll wrap being an involute portion disposed on said second scroll end plate, said second scroll member having an idler shaft disposed on said second end plate, said idler shaft having an axis of rotation offset from said axis of rotation of said drive shaft, said second scroll member cooperating with said first scroll member to define a line of zero crank angle and a centerline, said centerline being parallel to said axis of said drive shaft and said axis of said idler shaft and equidistant therebetween;

iv. selectively positioned means for drivingly coupling said first scroll member and said second scroll member, said coupling means being of a predetermined mass and having a center of gravity disposed at a predetermined angle from the line of zero crank angle, the selective positioning of said coupling producing a moderating moment which proactively enhances the nutational stability of said scroll compressor by acting in opposition to and reducing the maximum tipping moment to which a selected one of said first and said second scroll members is subjected when said compressor is in operation;

v. means for rotatably supporting said idler shaft in said suction portion of said hermetic shell; and vi. means for rotating said first scroll drive shaft.

14. A method of enhancing nutational stability of a co-rotational scroll apparatus having a first rotatable scroll member and a second rotatable scroll member in interleaving engagement with said first scroll member, said first and said second scroll members each being subject to a tipping moment when said apparatus is in operation, said method comprising the steps of:

determining the maximum tipping moment to which at least one of members is subject in operation and the rotational position of said at least one scroll member at which said maximum tipping moment occurs; and engaging said first scroll member and said second scroll member with a coupling for joint rotation, said coupling being positioned in said scroll apparatus so that the moment created by the movement of said coupling due to the location of its center of gravity and its mass reduces the maximum tipping moment to which said at least one of said scroll members is subjected when said scroll apparatus is in operation.

15. A method of enhancing the nutational stability of a co-rotational scroll apparatus having a driven scroll member, said driven scroll member having an axis about which it rotates through a cycle of angular positions, said driven scroll member including a first involute scroll wrap, and an idler scroll member having an axis about which it rotates through said cycle of angular positions said idler scroll member including a second involute scroll wrap in interleaving engagement with said first scroll wrap, said drive scroll member being subject to a tipping moment and said idler scroll member being subject to a tipping moment when said scroll apparatus is in operation, said method comprising the steps of:

determining a line of zero crank angle;

determining the instantaneous tipping moment to which at least said idler scroll member is subjected at each said angular position when said scroll apparatus is in operation;

determining the maximum tipping moment to which at least said idler scroll member is subjected when said scroll apparatus is in operation and the angular position at which said maximum tipping moment occurs with respect to said line of zero crank angle;

determining an angle from said line of zero crank angle at which to dispose a mass for producing a moderating moment for counteracting said maximum tipping moment to which at least said idler scroll member is subjected; and engaging said drive scroll member and said idler scroll member with coupling means for joint rotation, said coupling means having a predetermined mass and center of gravity disposed at said angle, so that the mass of said coupling means produces said moderating moment for counteracting said maximum tipping moment to which at least said idler scroll member is subjected to when said scroll apparatus is in operation.

16. The method as set forth in claim 15 including the further steps of:

determining the instantaneous tipping moment to which said drive scroll member is subjected at each said angular position when said scroll apparatus is in operation;

determining the maximum tipping moment to which said drive scroll member is subjected when said scroll apparatus is in operation and the angular position of said drive scroll at which the maximum tipping moment occurs; said step of determining an angle from said line of zero crank angle at which to dispose a mass for producing a moderating moment for counteracting said maximum tipping moment to which at least said idler scroll member is subjected includes the additional step of determining an angle from said line of zero crank angle at which to dispose a mass for producing a moderating moment for counteracting said maximum tipping moment to which said drive scroll member is subjected; and said engaging step including the step of selecting the angle to dispose said coupling means which produces the higher moderating moment for counteracting the maximum tipping moment to which either the idler scroll member or drive scroll member is subjected to when said scroll apparatus is in operation.

17. The method as set forth in claim 15 wherein said coupling is generally symmetrical and wherein the method of enhancing the nutational stability of a co-rotational scroll apparatus includes the step of determining an angle at which to asymmetrically dispose a mass on said generally symmetrical coupling for producing said moderating moment.

* * * * *

UNITED STATES PATENT AND TRADEMARK OFFICE

CERTIFICATE OF CORRECTION

PATENT NO. : 5,099,658

DATED : March 31, 1992

INVENTOR(S) : Robert E. Utter and Daniel R. Crum

It is certified that error appears in the above-identified patent and that said Letters Patent is hereby corrected as shown below:

Column 1, Line 17, "spraidal" should read --spiroidal--.

Column 2, Line 7, "outer" should read --inner--.

Column 2, Line 27, "separatin" should read --separating--.

Column 3, Line 22, "constly" should read --costly--.

Column 5, Line 7, "annula" should read --annular--.

Column 8, Line 2, delete the word "with".

Column 8, Line 63, delete "'s'".

Signed and Sealed this

Twenty-first Day of September, 1993

Bruce Lehman

*Attest:*

BRUCE LEHMAN

*Attesting Officer*

*Commissioner of Patents and Trademarks*